US006951297B1

(12) United States Patent
Lopez

(10) Patent No.: US 6,951,297 B1
(45) Date of Patent: Oct. 4, 2005

(54) SANDPAPER DISPENSER

(76) Inventor: Bonnie Lopez, 31 S. 333rd La., Apt. B, Federal Way, WA (US) 98003

( * ) Notice: Subject to any disclaimer, the term of this patent is extended or adjusted under 35 U.S.C. 154(b) by 0 days.

(21) Appl. No.: 10/606,568

(22) Filed: Jun. 25, 2003

(51) Int. Cl.[7] ..... B26F 3/02

(52) U.S. Cl. ..... 225/22; 225/67; 225/89; 451/458; 451/491; 451/492; 451/493

(58) Field of Search ..... 451/458, 491–493; 225/22, 67–75, 89

(56) References Cited

U.S. PATENT DOCUMENTS

| | | | | | |
|---|---|---|---|---|---|
| 2,447,518 | A | * | 8/1948 | Marinsky | 225/22 |
| 2,465,194 | A | * | 3/1949 | Brouty | 451/492 |
| 2,475,476 | A | * | 7/1949 | Champayne | 451/491 |
| 2,489,005 | A | * | 11/1949 | Bourdunis | 451/493 |
| 2,809,476 | A | * | 10/1957 | Bourdunis | 451/491 |
| 3,034,267 | A | * | 5/1962 | Feeney | 451/492 |
| 4,275,827 | A | | 6/1981 | Cole | |
| 4,316,563 | A | | 2/1982 | Turner et al. | |
| 4,416,410 | A | | 11/1983 | Herrmann | |
| 4,454,974 | A | | 6/1984 | Cooke | |
| 4,466,563 | A | | 8/1984 | Zuss | |
| 4,478,011 | A | * | 10/1984 | Russell | 451/492 |
| 4,667,447 | A | * | 5/1987 | Barton | 451/494 |
| 4,762,259 | A | | 8/1988 | Kosa | |
| 4,781,316 | A | | 11/1988 | Freeberg | |
| 4,858,807 | A | | 8/1989 | Cvek | |
| 5,975,999 | A | * | 11/1999 | Nitta | 451/491 |
| 6,083,091 | A | * | 7/2000 | Anderson | 451/493 |
| 6,092,657 | A | | 7/2000 | Hopkins | |
| 6,145,771 | A | | 11/2000 | Santa Cruz et al. | |
| 6,419,571 | B2 | * | 7/2002 | Ueno | 451/495 |

* cited by examiner

*Primary Examiner*—Allan N. Shoap
*Assistant Examiner*—Jason Prone
(74) *Attorney, Agent, or Firm*—Christensen O'Connor Johnson Kindness PLLC

(57) ABSTRACT

A sandpaper dispenser (100) is provided. The sandpaper dispenser includes a frame (102) adapted to be coupled to a sanding device (106) and a sandpaper dispensing assembly 144 coupled to the frame. A sanding pad (105 or 110) is coupled to the frame. The sandpaper dispensing assembly is adapted to selectively dispense a length (108) of sandpaper to extend over the sanding pad.

34 Claims, 3 Drawing Sheets

SANDPAPER DISPENSER

FIELD OF THE INVENTION

The present invention relates generally to sandpaper dispensers, and more particularly, to sandpaper dispensers adapted to couple to a sander.

BACKGROUND OF THE INVENTION

Sandpaper and sanders are well known and have been in use for hundreds of years. Sandpaper is formed from a strong paper or other material coated on one surface with a layer of sand or other abrasive. A sander is used to hold and move a piece of sandpaper across a surface, to smooth or polish the surface. As a surface is sanded, inevitably the sand or other abrasive affixed to the sandpaper becomes dislodged from the sandpaper or the abrasive becomes clogged with removed material, significantly decreasing the effectiveness of the sandpaper. Thus, a user is forced to remove the piece of spent sandpaper attached to the sander, cut a new piece of sandpaper, and attach the sandpaper to the sander. As one can imagine, the process of sandpaper replacement is frequent, time consuming, labor intensive, and therefore expensive.

To facilitate the replacement of the sandpaper, and thus help to mitigate the labor required to replace sandpaper, sandpaper dispensers have been developed. In one previously developed sandpaper dispenser, such as disclosed in U.S. Pat. No. 6,092,657, issued to Hopkins, a box shaped housing is used to contain a roll of sandpaper therein. The sandpaper dispenser is remotely located from the sander, i.e., is positioned upon a workbench and accessed as needed. The sandpaper is dispensed through a slot in the housing. A cutting blade is attached to the housing to permit a user to pull from the box a selected length of sandpaper, and then cut the selected length off of the roll by use of the cutting blade.

Although effective, this previously developed sandpaper dispenser is not without its problems. For instance, a user must still stop the sander and remove the attached piece of spent sandpaper. The user must then locate the sandpaper dispenser, measure the appropriate length of sandpaper needed, and cut off the required length from the roll. The user then returns to the sander and attaches the new length of sandpaper to the sander. Only then may the user commence sanding. Therefore, although the previously developed sandpaper dispensers are effective, they still do not alleviate the labor intensive process necessitated by the frequent removal and attachment of sandpaper to the sander. Thus, a need exists for a sandpaper dispenser that dispenses sandpaper such that the sandpaper does not need to be measured, is coupled directly to the sander, applies new sandpaper rapidly, is inexpensive to manufacture, reliable, and meets the performance requirements of the end user.

SUMMARY OF THE INVENTION

One embodiment of a sandpaper dispenser formed in accordance with the present invention is provided. The sandpaper dispenser includes a frame adapted to couple to a sander and a sanding pad coupled to the frame. The sandpaper dispenser also includes a sandpaper dispensing assembly coupled to the frame and adapted to store a length of unused sandpaper, wherein the sandpaper dispensing assembly is adapted to selectively dispense the length of unused sandpaper to extend over the sanding pad.

Another embodiment of a sandpaper dispenser and sander combination formed in accordance with present invention is provided. The sandpaper dispenser and sander combination includes a sander having a moving portion adapted to move in a sanding motion and a frame coupled to the moving portion. A sandpaper dispensing assembly and a sanding pad are coupled to the frame. The sandpaper dispensing assembly is adapted to selectively dispense a length of sandpaper to extend over the sanding pad.

Yet another embodiment of a sandpaper dispenser formed in accordance with the present invention is provided. The sandpaper dispenser includes a frame adapted to couple to a sander and includes sandpaper dispensing means for selectively dispensing sandpaper. The sandpaper dispensing means and the sanding pad are coupled to the frame. The sandpaper dispensing means is adapted to selectively dispense a length of sandpaper to extend over the sanding pad.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
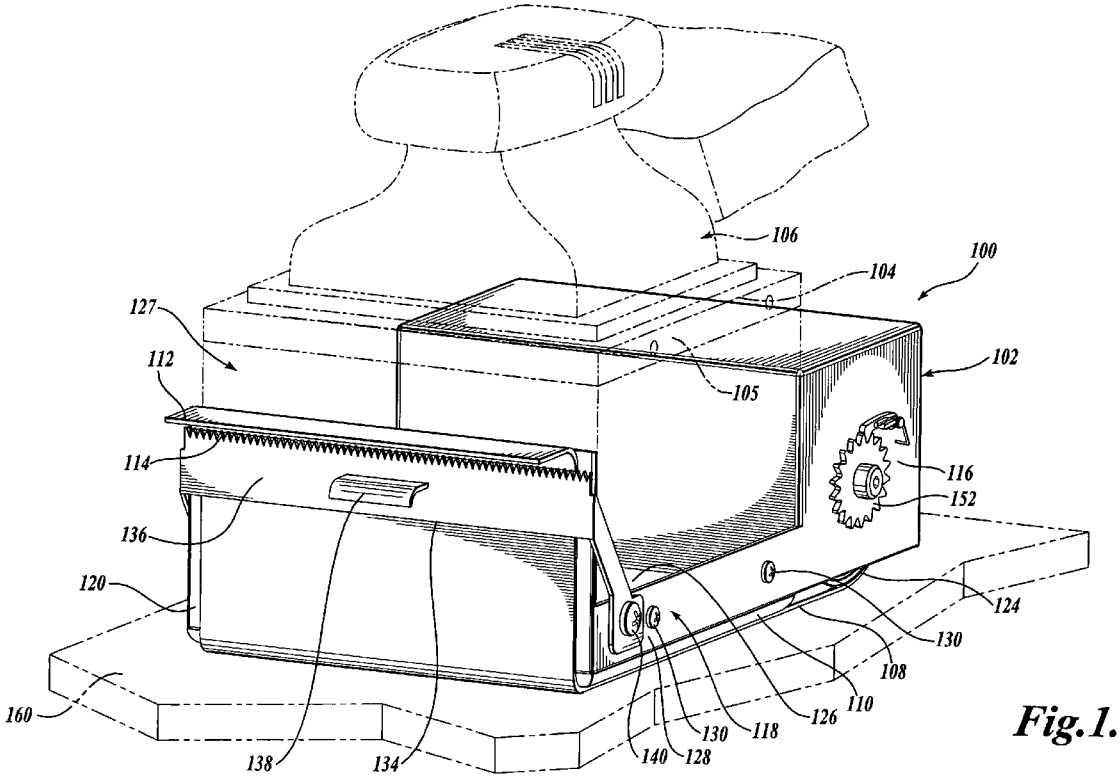
FIG. 1 is a partial exploded isometric view of one embodiment of a sander and a sandpaper dispenser formed in accordance with the present invention, wherein a length of sandpaper is shown extending from a sandpaper dispensing assembly, over a sanding pad, and terminating at a sandpaper restraining device.
Figure 2:
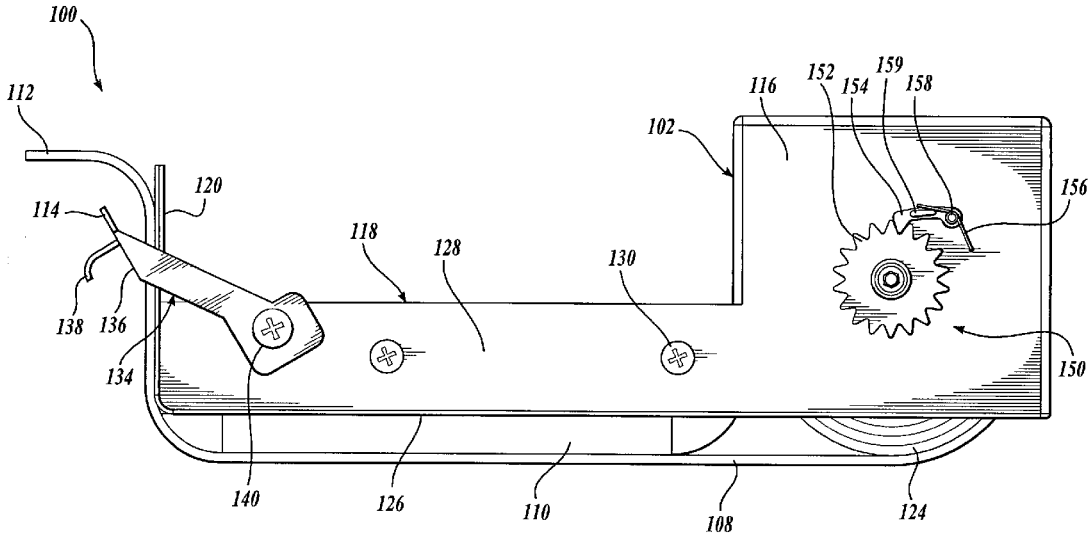
FIG. 2 is a side view of the sandpaper dispenser depicted in FIG. 1.
Figure 3:
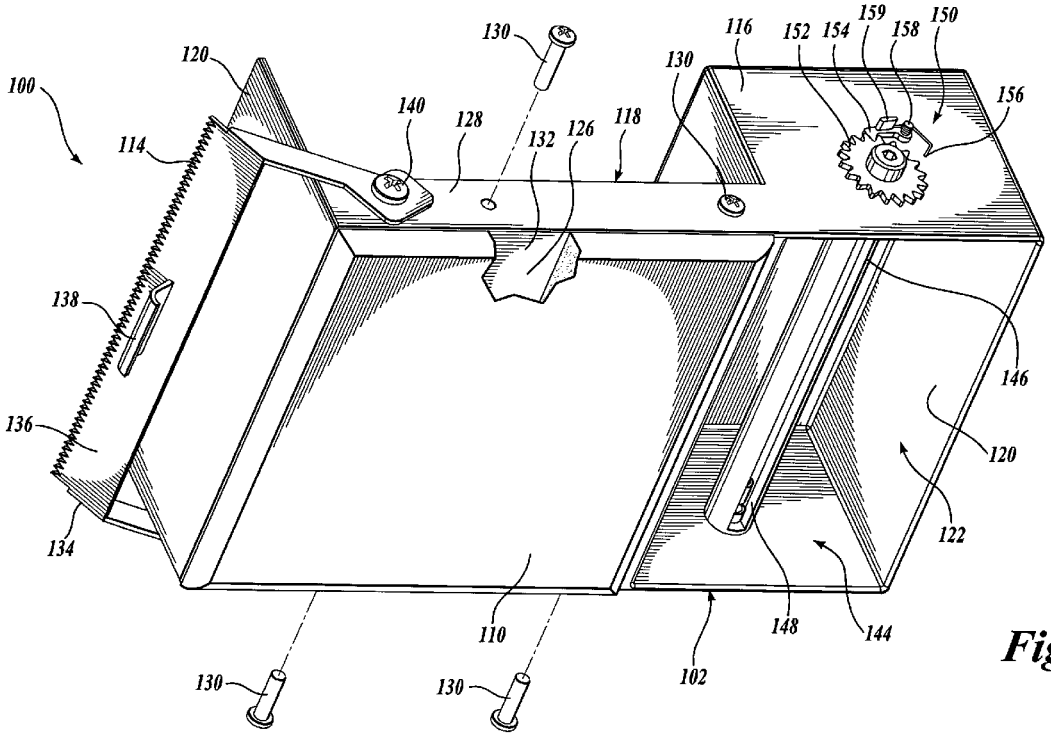
FIG. 3 is an isometric view of a bottom portion of the sandpaper dispenser of FIG. 1, wherein the sandpaper has been removed from the sandpaper dispenser for clarity.

FIGS. 1–3 illustrate one embodiment of a sandpaper dispenser 100 formed in accordance with the present invention. Turning to FIG. 1 and generally described, the sandpaper dispenser 100 includes a frame 102 adapted to be coupled to a moving portion 104 of a sander 106 such that the frame 102 is driven in a sanding motion. The sandpaper dispenser 100 selectively dispenses a length of sandpaper 108 across a sanding pad 110 coupled to the frame 102. As the sandpaper 108 is used and a decrease in effectiveness of the sandpaper realized, a fresh piece of sandpaper 108 may be positioned underneath the sanding pad 110 by pulling on a distal end 112 of the length of sandpaper 108. The spent portion of the sandpaper 108 may be removed by a cutting surface 114 coupled to the frame 102.

In light of the above general description of the sandpaper dispenser 100, a more detailed description of the sandpaper dispenser 100 will now commence. The frame 102 of the sandpaper dispenser 100 is preferably made of a rigid material, such as steel. The frame 102 may be comprised of three distinct sections: a dispensing assembly housing 116, a tray portion 118, and a restraining wall 120.

Referring to FIG. 3, the dispensing assembly housing 116 may be shaped as a rectangular box, and have an open end 122 for permitting the insertion of a roll 124 (See FIG. 2) of sandpaper therein. The tray portion 118 may be coupled to the dispensing assembly housing 116 along its lower end and may include a bottom wall 126, two sidewalls 128 (one shown) disposed parallel with a longitudinal axis of the sandpaper dispenser 100, and two endwalls disposed perpendicular with the longitudinal axis of the sandpaper dispenser 100. The restraining wall 120 may be mounted at an end of the side wall 128 opposite the dispensing assembly housing 116. The restraining wall 120 may extend perpendicularly upward from the bottom wall 126 and may be disposed perpendicular to the longitudinal axis of the sandpaper dispenser 100. Alternatively, the two endwalls may be integral with, i.e. formed by, the dispensing assembly housing 116 and the restraining wall 120.

Returning to FIG. 1, the tray portion 118 forms a cavity 127 sized and dimensioned to accept the moving portion 104 of the sander 106. For the purposes of this detailed description, a "moving portion" of a sander is defined as any portion of the sander which is driven in a sanding motion. In the illustrated embodiment, the cavity 127 formed by the tray portion 118 is sized and configured to receive a moving portion 104 or the sanding pad 105 of a standard quarter sheet orbital finish sander, one suitable example being a sander manufactured by MAKITA U.S.A., Inc. of La Mirada, Calif., Model No. BO4552K. The sanding pad 105 may be coupled to the frame 102 by any suitable means known in the art. In the illustrated embodiment, the sanding pad 105 is coupled to the tray portion 118 by four well known fasteners 130 (best seen in FIG. 3) which extend through apertures in the sidewalls 128 to removably engage the sanding pad 105 of the sander 106.

Although the illustrated embodiment depicts the sandpaper dispenser 100 as coupled to the sander 105 through the use of four fasteners, it should be apparent to those skilled in the art that the sandpaper dispenser 100 may be attached by any suitable means, such as by clips, by integrally forming the sandpaper dispenser 100 with the sander 105, by clamps, by locking mechanisms, to name a few.

The sanding pad 110 may be coupled to an outer surface 132 of the bottom wall 126 as best seen in FIG. 3. The sanding pad 110 may be coupled to the outer surface 132 by any suitable means, such as by chemical fasteners, such as adhesives, mechanical fasteners, such as rivets, etc. The sanding pad 110 may be made from any suitable sanding pad material, such as felt, rubber, etc. The sanding pad 110 is preferably a planar member having a uniform thickness with beveled edges; however, other geometries are suitable for use with a sandpaper dispenser 100 formed in accordance with the present invention.

The sandpaper dispenser 100 may further include a sandpaper restraining device 134. The sandpaper restraining device 134 includes an engagement member 136. The engagement member 136 is pivotally coupled to the frame 102 along the side wall 128 and is moveable between a first position and a second position. In the first position, shown in FIGS. 2 and 3, the engagement member 136 is disposed away from the frame 102. In the second position, shown in FIG. 1, the engagement member 136 is pivoted toward the restraining wall 120 so as to engage and hold a length of sandpaper 108 between the engagement member 136 and the restraining wall 120 of the frame 102.

Coupled to the engagement member 136 is a gripping device 138, as shown in FIGS. 1–3. The gripping device 138 permits a user to grip and apply a force to the engagement member 136 to pivot the engagement member 136 between the first and second positions. Once released, the engagement member 136 may be held in the first or second position by the friction present at the pivot points 140 (one shown) about which the engagement member 136 pivots. Alternatively, the engagement member 136 may be biased into the second position by a biasing device, such as spring, such that when released, the engagement member 136 is biased against the restraining wall 120. Thus, any sandpaper disposed between the engagement member 136 and the restraining wall 120 is held against the restraining wall 120 by the force applied by the biasing device.

Although a particular sandpaper restraining device 134 is depicted and described, it should be apparent to those skilled in the art that any device able to impede the movement of the sandpaper in at least one direction is suitable for use with the present invention. For instance, the sandpaper restraining device 134 may alternatively be formed by a clamping device, by a ratchet system which allows the sandpaper to move through the sandpaper restraining device 134 in a first direction, but not in a second direction opposite the first, etc. Or the sandpaper restraining device 134 may include a hand of a user applying hand pressure upon the sandpaper to sandwich the sandpaper between a portion of the sandpaper dispenser 100 and the hand of the user to impede movement of the sandpaper.

The restraining device 134 may also include a cutting surface 114 adapted to cut off a distal end of the length of sandpaper 108 (See FIG. 1). The cutting surface 114 may be disposed along a distal edge of the engagement member 136. The cutting surface 114 of the illustrated embodiment is formed by a serrated knife edge, however it should be apparent to those skilled in the art that the cutting surface may be formed in alternate manners, such as by a straight knife edge, etc.

Returning to FIG. 3, the sandpaper dispenser 100 includes a sandpaper dispensing assembly 144, which may be coupled to the sandpaper dispensing assembly housing 116. The sandpaper dispensing assembly 144 may include a support member 146. In the illustrated embodiment, the support member 146 is rotatingly and centrally disposed within the sandpaper dispensing assembly housing 116. The support member 146 may include a slot 148, the slot 148 sized and configured to accept an end (not shown) of a length of sandpaper 108 (See FIG. 1). Additional sandpaper may then be wrapped about the support member 146 to create the roll 124 (See FIG. 2) of sandpaper. Alternatively, prewound rolls containing their own support member 146 may be inserted and rotatingly coupled within the sandpaper dispensing assembly housing 116. Further, the support member 146 may be inserted within a core of a roll of sandpaper. In such an embodiment, the support member 146 is preferably configured to couple to the core of the roll of sandpaper, such as by an interference fit, whereby any rotation of the sandpaper roll is transferred to the support member 146.

Referring now to FIGS. 2 and 3, the sandpaper dispensing assembly 144 may include a tensioning system 150. The tensioning system 150 preferably maintains the roll 124 of sandpaper in a stationary position so that the length of sandpaper 108 may be tensioned. Alternatively, the tensioning system 150 may bias the roll 124 to apply a tension force in the length of sandpaper 108.

The tensioning system 150 of the illustrated embodiment includes a cogwheel 152 coupled to one end of the support member 146 such that rotation of the support member 146 causes a corresponding rotation of the cogwheel 152. The cogwheel 152 may be disposed on an exterior side of a sidewall of the sandpaper dispensing assembly housing 116. The cogwheel 152 may be acted upon by a locking lever 154 or pawl normally biased about a pivot pin 158 to engage the cogs of the cogwheel 152 by a biasing device, which in the illustrated embodiment is a spring 156. The engagement of the locking lever 154 with the cogs of the cogwheel 152 holds the roll 124 of sandpaper stationary. When the locking lever 154 is disengaged from the cogwheel 152, such as by rotating the locking lever 154 about the pivot pin 158 by pressing on knob 159, the roll 124 of sandpaper is free to rotate.

Turning to FIG. 1, in light of the above description of the components of the sandpaper dispenser 100, the operation of the sandpaper dispenser 100 will now be described. During installation, the sander 106 may be coupled to the sandpaper dispenser 100 by lowering the moving portion 104 of the sander 106, which in the illustrated embodiment is the sanding pad 105 of the sander 106, into the tray portion 118 of the frame 102. The sanding pad 105 may be coupled to the sanding pad 105 by four well known fasteners 130 (two shown in FIG. 1). Inasmuch as the sandpaper dispenser 100 is rigidly coupled to the sanding pad 105 of the sander 106, any movement of the sanding pad 105 generated by the sander 106 is transferred to the sandpaper dispenser 100.

Referring to FIGS. 1 and 3, sandpaper may then be loaded into the sandpaper dispensing assembly 116. This may be accomplished by inserting an end (not shown) of the sandpaper into the slot 146 of the support member 148, releasing the locking lever 154, and rolling the sandpaper upon the support member 146. A distal end 112 of the sandpaper may be pulled across the sanding pad 110 of the sandpaper dispenser 100 and inserted between the engagement member 136 of the sandpaper restraining device 134 and the restraining wall 120. The locking lever 154 is released to engage the cogwheel 152. The length of sandpaper 108 may be tensioned by pulling on the distal end 112. The sandpaper restraining device 134 is transitioned from the first position depicted in FIG. 2 to the second position in FIG. 1, thereby restraining the distal end 112 of the length of sandpaper 108 against the restraining wall 120.

The sander 106 may be turned on, such that a driver, such an electric motor, of the sander 106 imparts a sanding motion to the moving portion 104 of the sander 106. The sanding motion may take many suitable forms such as orbital, vibration, random, linear, rotary, etc. The sanding motion is transferred from the sanding pad 105 of the sander to the frame 102. As the frame 102 moves in the sanding motion, the sanding pad 110 of the sandpaper dispenser 100 is moved across a surface 160 to be sanded, moving the length of sandpaper 108 across the surface 160 in the sanding motion. The abrasive material on the length of sandpaper 108 smoothes or polishes the surface 160 to be sanded, resulting in the loss or clogging of the abrasive material of the sandpaper in the process. When the sandpaper 108 looses effectiveness, the user may release the locking lever 154 from the cogwheel 152 and pull on the first end 112 of the length of sandpaper 108. As the user pulls on the distal end 112, unused sandpaper is dispensed from the sandpaper dispensing assembly 116 and positioned to extend across the sanding pad 110. The spent sandpaper extending beyond the engagement member 136 of the sandpaper restraining device 134 is removed by tearing the length of spent sandpaper across the cutting surface 114.

Referring to FIG. 1, although the illustrated embodiment of the present invention is described as having the sanding pad 105 of the sander 106 resting within a tray 118 portion of the present invention, it should be apparent to those skilled in the art that alternate configurations are suitable for use with and are within the spirit and scope of the present invention. For instance, the bottom wall 126 of the tray 118 may contain an aperture to permit the sanding pad 105 of the sander 106 to pass through the bottom wall 126 so as to be positioned substantially in the location of sanding pad 110. Thus, the sanding pad 105 of the sander 106 becomes the sanding pad 110 of the sandpaper dispenser 100, thereby reducing the number of sanding pads from two to one.

Although a mechanically driven sanding device is depicted in the illustrated embodiment, it should be apparent to those skilled in the art that sanding devices driven by other than mechanical means are suitable for use and within the spirit and scope of the present invention. For instance, the sanding device may include a sanding block manually driven in a sanding motion by a user.

Although a rectangular sanding pad is depicted and described in the illustrated embodiment as attached to both the sander and bottom wall 126 of the frame 102, it should be apparent to those skilled in the art that the sandpaper dispenser 100 may be adapted to interface with sanding pads of other geometries, such as round or pointed sanding pads, to name a few.

Although a manually operated sandpaper dispensing assembly 144 is depicted and described in relation to the illustrated embodiments, it should be apparent to those skilled in the art that the sandpaper dispensing assembly 144 may be suitably driven by other means, such as by electric or pneumatic drivers, to name a few.

Although the illustrated sandpaper dispenser is preferably a reusable item loaded with new sandpaper on an as needed basis, it should be apparent to those skilled in the art that a disposable, preloaded sandpaper dispenser is suitable for use with and is within the spirit and scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A sandpaper dispenser comprising:

(a) a frame adapted to couple to a sander having a first sanding pad made from a flexible material;

(b) a second sanding pad coupled to the frame, the second sanding pad made from a flexible material;

(c) a sandpaper dispensing assembly coupled to the frame and adapted to store a length of unused sandpaper, wherein the sandpaper dispensing assembly is adapted to selectively dispense the length of unused sandpaper to extend over the second sanding pad; and (d) wherein the second sanding pad is coupled to the frame such that the second sanding pad is adapted to be sandwiched between the frame and the length of unused sandpaper when the length of unused sandpaper is extended over the second sanding pad.

2. The sandpaper dispenser of claim 1, wherein the frame includes a tray portion, the tray portion adapted to receive the first sanding pad upon a first surface of a wall of the tray and the second sanding pad on an opposite surface of the wall.

3. The sandpaper dispenser of claim 1, wherein the sandpaper dispensing assembly includes a support member adapted to rotatingly dispense sandpaper.

4. The sandpaper dispenser of claim 1 further comprising a cutting surface coupled to the frame, the cutting surface adapted to selectively cut sandpaper.

5. The sandpaper dispenser of claim 1, further including a sandpaper restraining device coupled to the frame at a location spaced from the sandpaper dispensing assembly, the sandpaper restraining device adapted to hold a distal end of the length of unused sandpaper once extended over the second sanding pad.

6. The sandpaper dispenser of claim 5, wherein the sandpaper restraining device includes a cutting surface adapted to assist a user in cutting sandpaper.

7. The sandpaper dispenser of claim 5, wherein the sandpaper restraining device is moveable between a first position in which the restraining device is adapted to hold sandpaper stationary relative to the frame and a second position in which the restraining device is adapted to permit sandpaper to move in at least one direction relative to the frame.

8. The sandpaper dispenser of claim 1, wherein the frame is adapted to be coupled to the sander so that the frame is disposed between the first and second sanding pads.

9. The sandpaper dispenser of claim 1, wherein the sandpaper dispensing assembly further comprises a tensioning system for holding the length of unused sandpaper in a tensioned condition.

10. The sandpaper dispenser of claim 9, wherein the tensioning system is positionable between a first position in which the sandpaper dispensing assembly is impeded from dispensing sandpaper and a second position in which the sandpaper dispensing assembly is free to dispense sandpaper.

11. The sandpaper dispenser of claim 1, wherein the frame is adapted to be coupled to the sander so that the second sanding pad is disposed below the first sanding pad.

12. The sandpaper dispenser of claim 1, wherein the frame covers a majority of a bottom surface of the first sanding pad when the frame is coupled to the sander.

13. A sandpaper dispenser and sander combination comprising:

(a) a sander having a moving portion adapted to move in a sanding motion;

(b) a frame coupled to the moving portion;

(c) a sandpaper dispensing assembly coupled to the frame;

(d) a sanding pad coupled to the frame, wherein the frame is adapted to hold the sanding pad a predetermined distance away from the moving portion; and (e) wherein the sandpaper dispensing assembly is adapted to selectively dispense a length of sandpaper to extend over the sanding pad.

14. The sandpaper dispenser and sander combination of claim 13, wherein the frame includes a tray portion, the tray portion coupled to the moving portion so as to extend underneath a majority of the moving portion.

15. The sandpaper dispenser and sander combination of claim 13, wherein the sandpaper dispensing assembly includes a support member adapted to rotatingly dispense sandpaper.

16. The sandpaper dispenser and sander combination of claim 13, wherein the sanding pad is coupled to the frame, and wherein the frame overlies a majority of a top surface of the sanding pad such that the sanding pad is adapted to be sandwiched between the frame and the length of sandpaper when the length of sandpaper is extended over the sanding pad.

17. The sandpaper dispenser and sander combination of claim 13 further comprising a cutting surface coupled to the frame, the cutting surface adapted to selectively cut the length of sandpaper.

18. The sandpaper dispenser and sand combination of claim 13 further comprising a sandpaper restraining device coupled to the frame at a location spaced from the sandpaper dispensing assembly, the sandpaper restraining device adapted to hold a distal end of the length of sandpaper once extended over the sanding pad.

19. The sandpaper dispenser and sander combination of claim 18, wherein the sandpaper restraining device includes a cutting surface adapted to assist a user in cutting sandpaper.

20. The sandpaper dispenser and sander combination of claim 18, wherein the sandpaper restraining device is moveable between a first position in which the sandpaper restraining device grips the length of sandpaper to impede movement of the sandpaper relative to the frame and a second position in which the sandpaper restraining devices permits the length of sandpaper to move relative to the frame.

21. The sandpaper dispenser and sander combination of claim 18, wherein the sandpaper dispensing assembly further comprises a tensioning system for holding sandpaper in a tensioned condition.

22. The sandpaper dispenser and sander combination of claim 21, wherein the tensioning system is positionable between a first position in which the sandpaper dispensing assembly is impeded from dispensing sandpaper and a second position in which the sandpaper dispensing assembly is free to dispense sandpaper.

23. A sandpaper dispenser comprising:

(a) a frame adapted to couple to a sander having a first sanding pad made from a non-rigid material;

(b) sandpaper dispensing means for selectively dispensing sandpaper, the sandpaper dispensing means coupled to the frame;

(c) a second sanding pad coupled to the frame, the second sanding pad made from a non-rigid material;

(d) wherein the sandpaper dispensing means is adapted to selectively dispense a length of sandpaper to extend over the second sanding pad; and (e) a cutting surface coupled to the frame, the cutting surface adapted to selectively cut the length of sandpaper.

24. The sandpaper dispenser of claim 23, wherein the frame is adapted to be coupled to the sander so that the frame is disposed between the first and second sanding pads.

25. The sandpaper dispenser of claim 23, wherein the second sanding pad is coupled to the frame such that the second sanding pad is adapted to be sandwiched between the frame and the length of sandpaper when the length of sandpaper is extended over the second sanding pad.

26. The sandpaper dispenser of claim 23 further comprising restraining means for selectively holding sandpaper stationary relative to the frame.

27. The sandpaper dispenser of claim 26, wherein the sandpaper restraining means includes a cutting surface adapted to assist a user in cutting away sandpaper.

28. The sandpaper dispenser of claim 26, wherein the sandpaper restraining means is moveable between a first position in which the sandpaper retraining means engages the length of the sandpaper to impede movement of the sandpaper relative to the frame, and a second position in which the sandpaper restraining means permits the length of the sandpaper to move relative to the frame.

29. The sandpaper dispenser of claim 23, wherein the frame is adapted to be coupled to the sander so that the frame is disposed between the first and second sanding pads.

30. The sandpaper dispenser of claim 23, wherein the sandpaper dispensing means further comprises a tensioning means for holding sandpaper stationary relative to the frame.

31. The sandpaper dispenser of claim 30, wherein the tensioning system is positionable between a first position in which the sandpaper dispensing means is impeded from dispensing sandpaper and a second position in which the sandpaper dispensing means is free to dispense sandpaper.

32. A sandpaper dispenser comprising:

(a) a frame adapted to couple to a sander having a first sanding pad made from a flexible material;

(b) a second sanding pad coupled to the frame, the second sanding pad made from a flexible material;

(c) a sandpaper dispensing assembly coupled to the frame and adapted to store a length of unused sandpaper, wherein the sandpaper dispensing assembly is adapted to selectively dispense the length of unused sandpaper to extend over the second sanding pad; and (d) wherein the frame includes a tray portion, the tray portion adapted to receive the first sanding pad upon a first surface of a wall of the tray and the second sanding pad on an opposite surface of the wall.

33. A sandpaper dispenser comprising:

(a) a frame adapted to couple to a sander having a first sanding pad made from a non-rigid material;

(b) a second sanding pad coupled to the frame, the second sanding pad made from a non-rigid material;

(c) a sandpaper dispensing assembly coupled to the frame and adapted to store a length of unused sandpaper, wherein the sandpaper dispensing assembly is adapted to selectively dispense the length of unused sandpaper to extend over the second sanding pad; and (d) a cutting surface coupled to the frame, the cutting surface adapted to selectively cut sandpaper.

34. A sandpaper dispenser comprising:

(a) a frame adapted to couple to a sander having a first sanding pad made from a flexible material;

(b) a second sanding pad coupled to the frame, the second sanding pad made from a flexible material;

(c) a sandpaper dispensing assembly coupled to the frame and adapted to store a length of unused sandpaper, wherein the sandpaper dispensing assembly is adapted to selectively dispense the length of unused sandpaper to extend over the second sanding pad; and (d) a sandpaper restraining device coupled to the frame at a location spaced from the sandpaper dispensing assembly, the sandpaper restraining device adapted to hold a distal end of the length of unused sandpaper once extended over the second sanding pad.

* * * * *

UNITED STATES PATENT AND TRADEMARK OFFICE

CERTIFICATE OF CORRECTION

PATENT NO. : 6,951,297 B1
DATED : October 4, 2005
INVENTOR(S) : B. Lopez

It is certified that error appears in the above-identified patent and that said Letters Patent is hereby corrected as shown below:

Title page,
Item [76], Inventor, "31 S. 333rd La., Apt. B, Federal Way, WA (US) 98003" should read -- 6631 20th Street East, Fife, WA (US) 98424 --.

Column 6,
Line 59, "claim 1" should read -- claim 1, --.

Column 7,
Lines 59 and 63, "claim 13" should read -- claim 13, --.
Line 62, "sand" should read -- sander --.

Column 8,
Line 10, "devices" should read -- device --.
Line 44, "claim 23" should read -- claim 23, --.

Signed and Sealed this

Twenty-first Day of February, 2006

JON W. DUDAS
*Director of the United States Patent and Trademark Office*